United States Patent [19]

Smith et al.

[11] 3,989,149

[45] Nov. 2, 1976

[54] EXCAVATING DEVICE

[75] Inventors: Neil L. Smith; Harold Lambert, both of Sudbury, Canada

[73] Assignee: Auburn Equipment Limited, Sudbury, Canada

[22] Filed: Nov. 4, 1974

[21] Appl. No.: 520,962

Related U.S. Application Data

[63] Continuation-in-part of Ser. No. 450,545, March 13, 1974, abandoned.

[52] U.S. Cl. ..... 214/138 R; 212/145

[51] Int. Cl.[2] ..... E02F 3/32

[58] Field of Search ..... 212/145; 214/138 R; 280/415 R, 150.5; 180/8 R

[56] References Cited

UNITED STATES PATENTS

| | | | |
|---|---|---|---|
| 3,310,181 | 3/1967 | Symmank | 212/145 |
| 3,351,221 | 11/1967 | Smalley | 214/138 R |
| 3,433,374 | 3/1969 | Menzi | 214/138 R |
| 3,635,364 | 1/1972 | Tingleff | 214/138 R |
| 3,768,674 | 10/1973 | Menzi | 212/145 |

FOREIGN PATENTS OR APPLICATIONS

| | | | |
|---|---|---|---|
| 1,803,838 | 12/1969 | Germany | 214/138 R |

*Primary Examiner*—Robert J. Spar
*Assistant Examiner*—Ross Weaver

[57] ABSTRACT

An excavating device comprising a platform for mounting a hydraulic backhoe. The device has independently operable stabilizers. The stabilizers can act to level the device for working on slopes and provide for leverage when using a backhoe bucket. The device is adapted to be readily assembled and disassembled for working within closed structures or on raised platforms.

7 Claims, 4 Drawing Figures

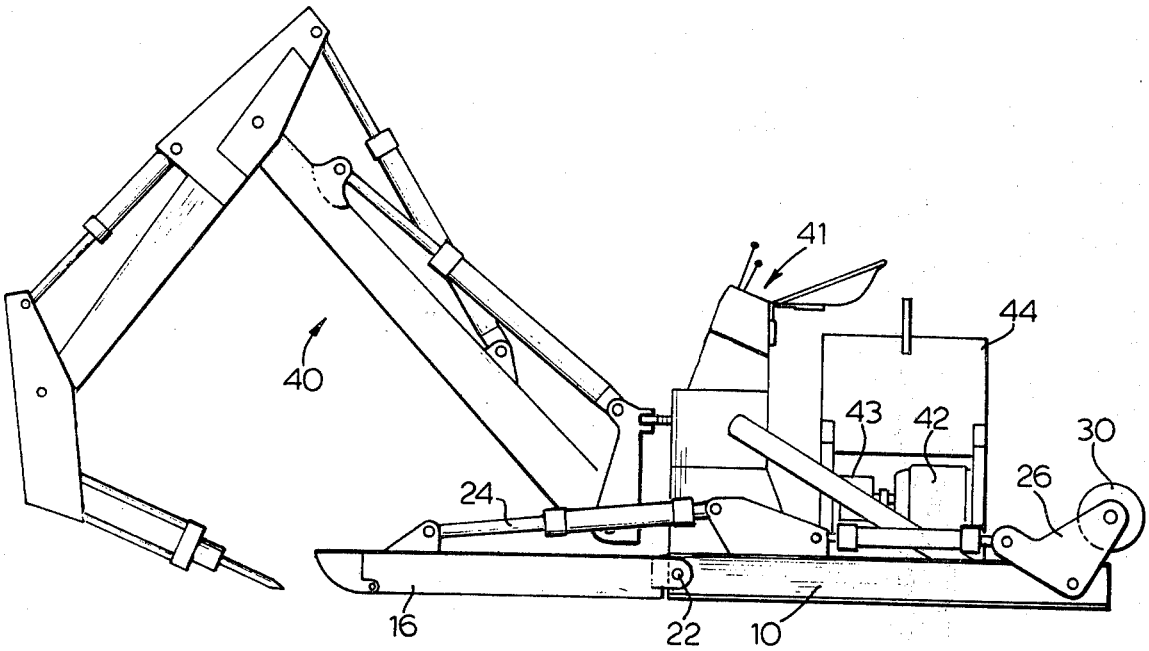
FIG. 1
FIG. 2
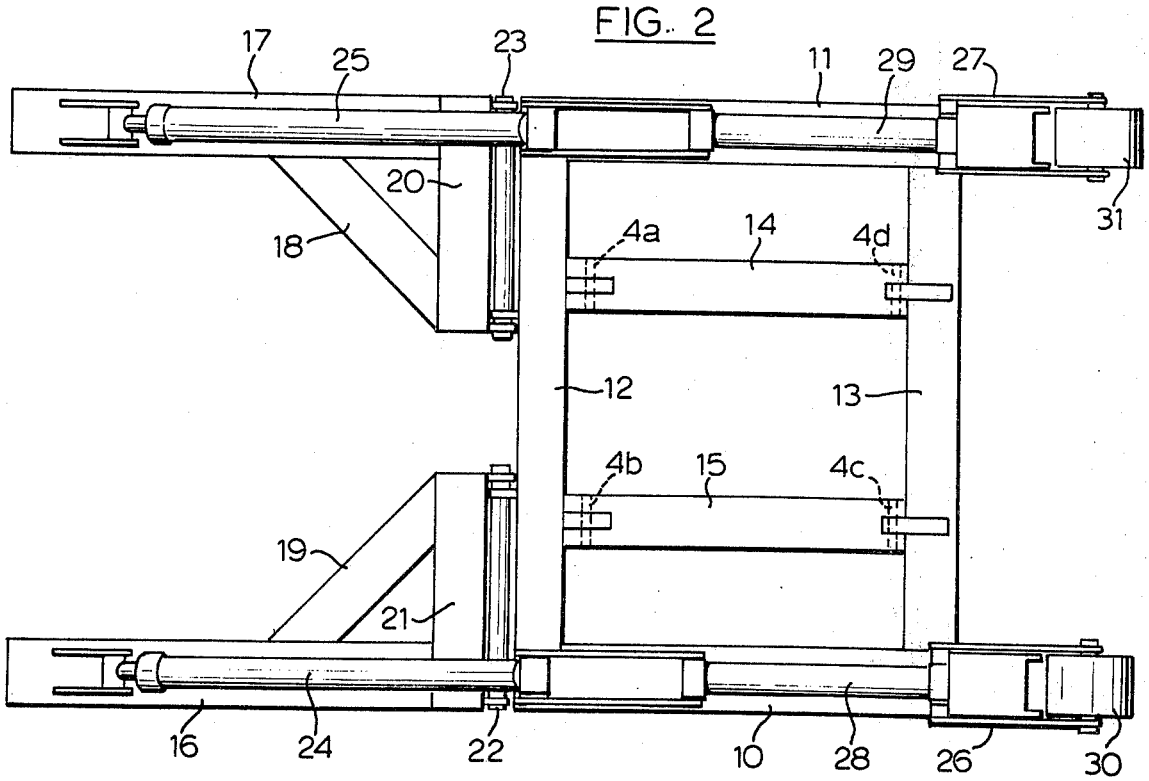

EXCAVATING DEVICE

This application is a continuation-in-part of Application Ser. No. 450,545 filed Mar. 13, 1974 now abandoned.

This invention relates to novel construction equipment and comprises a platform on which construction implements may be mounted.

There are several types of excavating machines which are well known in the art. Wide use is made of the normal track laying tractor such as the Case Model 450 or Model 850 loader or bulldozer. These vehicles are often modified in such a manner that a backhoe and conventional hydraulic boom of the backhoe is fitted to a loader in a known manner and can be used either with a bucket or demolition hammer or other construction implement. The vehicle is often equipped with stabilizers which raise the vehicle off the ground when the backhoe is being used. Similarly, large and powerful agricultural tractors mounted on wheels may be modified. Each of these types of excavators are particularly useful in working in large open areas, where mobility is a prime requisite. However, each of these types of equipment prove entirely unsuitable when the equipment is to be used in a confined space where there is insufficient space to operate the tractor. Such space limitations are often present in the mining and smelting industry when it is desired to work either in the underground mine areas, in ore storage bins, or smelter furnaces and related areas. Such equipment is also subject to very high maintenance costs when used in the abrasive conditions of mining and smelting. This maintenance is related to the track laying equipment or other driving equipment of the tractor which of course is not necessary where high mobility of the equipment is not required. Such tractors normally also involve relatively high maintenance costs related to the use of the usual diesel power plant to power the hydraulic pump required to operate the boom. It is possible to use such tractor type equipment only in locations where the access is at least as large as the tractor as normally disassembly of the tractor is completely impractical if not impossible.

It is also well known to use a backhoe mounted upon a fixed pedestal. Such equipment is often used underground in mines. In these installations the backhoe is mounted to a concrete or metal pedestal. This equipment does not suffer the high maintenance problems referred to above as the equipment does not involve any wheels or tracks. However, because the pedestal is fixed the equipment is not mobile at all. In the event the boom of the backhoe will not reach to a desired location it is impossible for the operator to use the implement at that spot. This problem arises in the use of a boom mounted demolition hammer used to break up rock for passage through a grizzly within a mine. If some particular rock will not pass through the grizzly the demolition hammer must be used to break up the rock at that spot. In this instance the mobility provided by the invention described herein is particularly useful whereas the lack of mobility of the pedestal mounted equipment means the rock must be moved to within range of the pedestal mounted equipment. The pedestal mounted boom cannot be transferred or moved except to be mounted on another pedestal. Pedestal mounted equipment is often subject to early failure as a result of the absence of any type of shock absorbing equipment. Accordingly, such equipment is often subject to high repair costs.

Several specialty type excavators have been designed for particular functions. Excavators particularly suited for digging trenches have been described in U.S. Pat. No. 3,490,629 to Menzi, U.S. Pat. No. 3,534,877 to Menzi, U.S. Pat. No. 3,589,538 to Menzi and U.S. Pat. No. 3,499,559 to Pedersen. All of the above excavators have been built on specially modified platforms. However, none of the above specialty devices are suitable for use in confined spaces and are not readily disassemblable. In addition, such devices do not provide the relative simplicity of the present invention which provides a platform which is adjustable for uneven or sloped surfaces and which provides the appropriate leverage for operation of the backhoe.

It is an object of this invention to provide a device which is of a size that the device may be used in confined areas while providing such device with mobility sufficient for use in such confined areas.

The mining industry in particular makes use of large ore storage bins which may be of the order of 60 feet in diameter and 80 feet high. Such storage bins require periodic cleaning. This job is accomplished to-day primarily by laborious methods. Although such bins are relatively large the access openings to such bins may be of the order of 3 feet by 7 feet located in the top of the bin. Accordingly, it is impractical if not impossible to use any of the known construction implements within such a bin where the access is so limited. The mining industry also uses large reverb furnaces which may be approximately 100 feet long by 12 feet high by 40 feet wide and converters which may be in the order of 37 feet long by 14 feet in diameter. Periodically it is necessary to remove the firebrick refractory lining from the interior of such furnaces and converters. Presently, such refractory removal is accomplished using a demolition hammer mounted upon a hydraulic boom. However, because such equipment must be used within an industrial smelter plant the boom must be mounted upon equipment which can operate within the plant on the floor or platform surface adjacent the opening to such furnace or converter. Track laying vehicles equipped with a boom and demolition hammer are usually relatively heavy weighing as much as 8 and a half tons even for relatively small tractor such as the Case Model 450. The weight often means that such tractors cannot be operated within the plant on a floor, sub-floor or platform which is not designed to support so great a total weight.

It is an object of this invention to provide a device whereby such tasks may be accomplished using powered excavating and demolition equipment rather than manual means and which device is suitable by weight and capability for use within a plant.

It is a further object of this invention to provide a device that does not require the relatively high maintenance requirement of the usual track laying equipment when subjected to the heats, dust, and rugged use conditions of the modern day industrial mining complex. The usual high maintenance requirements result from the track laying apparatus which is not necessary in the vehicle which does not require complete mobility. Also the fact that this unit may be operated electrically, within the plant confines, contributes to the modern ideal of reduced air pollution within confined in-plant areas, which, of necessity, must compatibly accommodate men as well as equipment.

The present invention comprises a relatively simple platform on which is mounted a standard hydraulic backhoe boom attachment complete with hydraulic power plant. The device may be comparatively easily disassembled and reassembled in a confined space thereby making it possible to use powered equipment in areas which because of limited access heretofore required manual methods. The device is such that the unit is provided with a reasonable degree of mobility within the restricted space and at the same time is equipped to provide suitable stability and leverage for operation of a backhoe or demolition hammer. The invention will now be described in conjunction with the following drawings which illustrate a preferred embodiment of the invention, and in which:

FIG. 1 is a general arrangement side view of an excavator according to the invention;

FIG. 2 is a plan view of the basic platform to which the backhoe hydraulic boom and operator controls are mounted;

Figure 3:
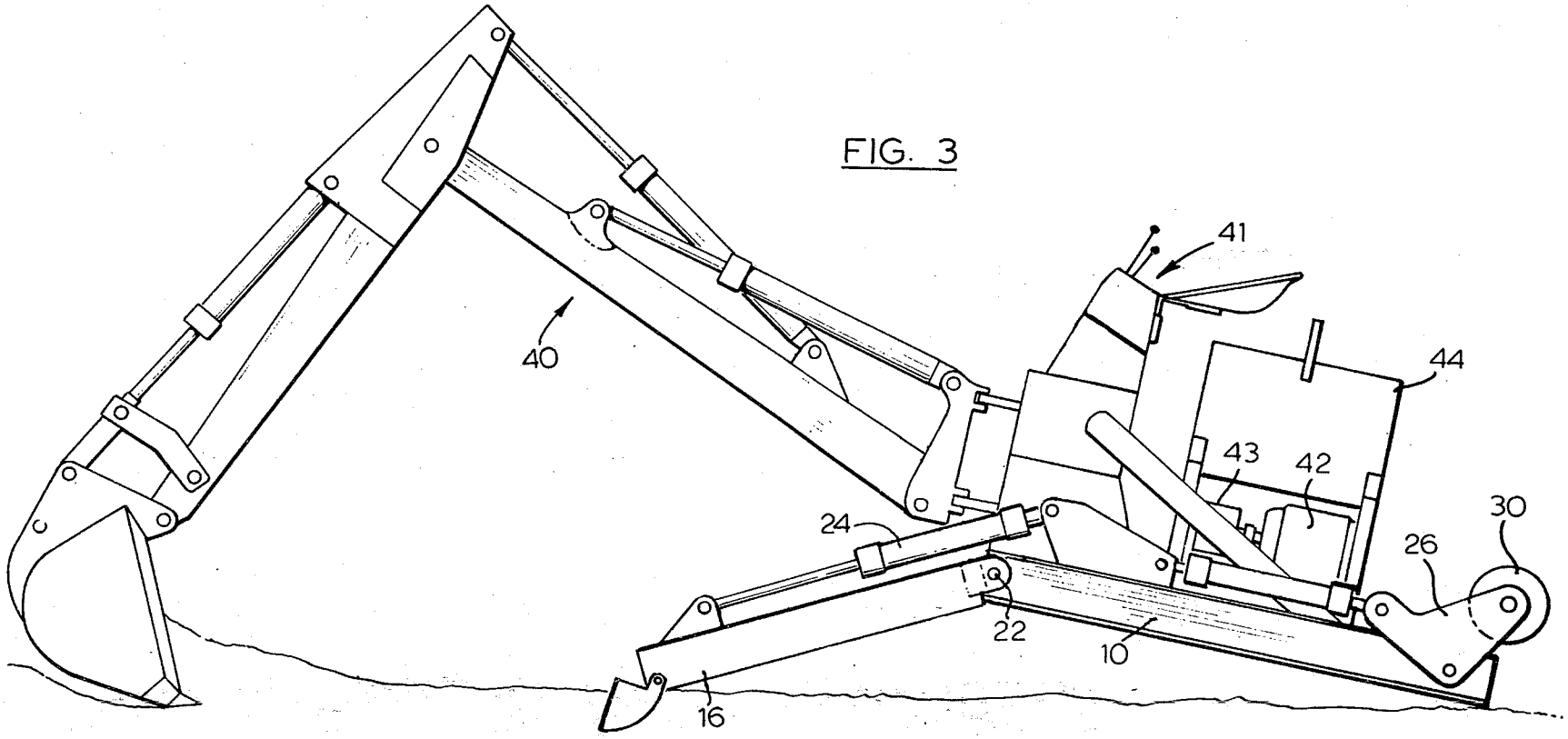
FIG. 3 is a side view of the device in operating position.

Explaining the device initially with reference to FIG. 2, the platform consists of a generally rectangular rigid portion consisting of side members 10 and 11 and front and rear cross-members 12 and 13. Members 10, 11, 12 and 13 may be made from any suitable steel beams and may be either box or I-beams. Between members 12 and 13 are two members 14 and 15. Members 14 and 15 provide bracing for the rigid portion and also provide the mounting points for attachment of the standard hydraulic construction implement or backhoe attachment. The hydraulic implement or backhoe attachment which is commercially available from such manufacturers as Case or Teledyne may be attached to the platform simply and easily by pins designated 4*a*, 4*b*, 4*c* and 4*d*. In FIG. 2 the hydraulic backhoe attachment and hydraulic power plant has been removed to show the construction of the platform. Extending forward from each of side members 10 and 11 are members 16 and 17. Members 16 and 17 may also be of any suitable configuration such as box-beams or I-beam sections. However, members 16 and 17 must be sufficiently strong to support the weight of the complete platform and hydraulic implement as once in operation these members will be supporting a significant portion of the total weight of the device and the forces resulting from use of the implement. Members 16 and 17 are braced by 45° angle braces 18 and 19. Angle braces 18 and 19 cooperate with members 20 and 21 to brace respectively members 17 and 16. Member 16 is affixed to the platform so as to be rotatable about the pin 22 in a vertical plane. It will be observed that member 16 may be rotated within the vertical plane without simultaneous rotation of the member 17 which is similarly attached to the platform by pivot pin 23. Independent rotation within the vertical plane of either of members 16 or 17 is accomplished by independent hydraulic cylinders 24 or 25, respectively. Hydraulic cylinders 24 and 25 are attached to members 16 and 17 by a suitable linkage and also to members 10 and 11. Each of the hydraulic cylinders 24 and 25 is independently operable hydraulically from the operator's console. The platform is also equipped with wheel carrying brackets 26 and 27. Wheel carrying brackets 26 and 27 are rotatably affixed to members 10, 11 and 13 to permit rotation of each bracket in the vertical plane. Rotation of either of brackets 26 or 27 is accomplished through hydraulic cylinders 28 or 29. It is to be noted that each of hydraulic cylinders 28 and 29 are independently operable from the operator's console. Each of brackets 26 and 27 are equipped with wheels 30 and 31. These wheels are mounted to the brackets to provide rotation by means of a simple pin or axle.

Referring now to FIG. 1, the platform is shown with a standard hydraulic backhoe package mounted thereon. The hydraulic backhoe package, which is commercially available, consists of a boom shown generally as 40, comprising several members, each of which is controlled by a hydraulic cylinder, and an operator console 41 to operate the boom as well as other hydraulically controlled members. These booms are manufactured presently for mounting on tractors, as discussed above, and require only four mounting points. Pin attachments 4*a*, 4*b*, 4*c* and 4*d*, must, of course, be located on the platform to conform to the specific mounting yokes for the manufacturer of the hydraulic backhoe package which is used.

In a preferred embodiment of the invention an electric motor 42 is used to power a hydraulic pump 43 which supplied hydraulic pressure to all of the cylinders on the platform. Hydraulic oil reservoir, 44, provides the necessary storage and cooling of hydraulic oil for the system. Although several types of motor are practical for the power unit to drive the hydraulic pump, the device may be used in closed or confined areas much more conveniently if an electric motor is used. Use of gasoline, diesel or air driven equipment while possible with this invention, detract from ability of the device to work in confined areas and would normally involve considerable extra equipment such as noise controls, exhaust scrubber equipment or air lines.

FIG. 3 shows the device in use. If the work surface is flat, members 16 and 17 are positioned by means of the hydraulic cylinders 24 and 25 so that the angle between members 10 and 16 and members 11 and 17 respectively, is 180°. The device merely rests upon the ground to be worked and may relatively easily be skidded along the ground using the hydraulic boom as the motive force of power. Of course the hydraulic boom will only be able to slide the platform approximately 15 feet with each stoke of the boom. In the event that the surface being worked on is particularly irregular and it is difficult to achieve movement in this fashion, the wheel carrying brackets 26, 27 may be rotated using hydraulic cylinders 28 and 29, respectively, until wheels 30 and 31 are in contact with the ground, thus raising one end of the platform off the ground. The hydraulic boom may then be used much more easily to move the platform back and forth. It is further envisioned that should the device be required within a different area within a plant, that the device could be towed using the wheels. In order to facilitate such towing, the hydraulic boom could be hooked on to the back of a pick-up truck or tractor which would then tow the vehicle using the wheels. Such a system would of course not be permitted on public highways but is adequate for moving the platform within a plant area. It is further envisioned that in certain plant applications requiring unique mobility on a concrete floor and within a reasonable area that a third hydraulically controlled pivotal wheel unit would be centrally attached to frame 12 to provide a three point wheel bearing for easy mobility between working sessions.

If the area being worked upon is not level either of members 16 or 17 or both members 16 and 17 may be rotated downwards, as shown in FIG. 3 until the rigid portion of the platform is in a suitable working plane. Because members 16 and 17 are independently rotatable the device can be used in a relatively horizontal stable working position on any slope, which may be compensated for by rotation of members 16 and 17. It will be obvious that the device cannot be used on a slope that is so steep that rotation of either of members 16 and 17 or members 16 and 17 together does not provide sufficient travel to level the rigid portion of the platform. However, for most use within an industrial plant or a mine or within an ore bin, rotation of members 16 and 17 will be more than sufficient to level the rigid portion of the platform.

The platform equipped with a basic backhoe attachment, may be used with any hydraulic construction implement. However, platform is especially suited for use with either a bucket or a demolition hammer. When a demolition hammer is fitted to the end of the boom, as is shown in FIG. 1, working leverage is not normally a problem. However, the mobility of the device, as explained above, will allow the operator to move the platform within a relatively limited area in order to reach to any point desired for use with the demolition hammer. The manufacturers of the standard hydraulic backhoe packages normally provide for easy interchange of various implements. The device is particularly useful for use with a backhoe bucket. When a backhoe bucket is being used operating leverage becomes important and is easily provided as shown in FIG. 3. If the platform is working on a substantially level horizontal work surface, each of members 16 and 17 can be rotated simultaneously so that the platform then contacts the ground at only four points. Most of the weight of the device including the operator console, boom, motor, and hydraulic pump is carried by the rigid portion of the platform. Accordingly, when members 16 and 17 have been rotated the greatest portion of the weight of the device will be generally at the centre line of pins 22 and 23. With the weight generally located at or to the rear of pins 22 and 23, the device then has suitable leverage for operation of the bucket. If the operator takes too deep a bite with the bucket, the device, of course, will be pulled forward towards the work area rather than the bucket travelling towards the platform. The operator will, of course, immediately become aware that too deep a bite has been taken and can reposition the bucket. This way the operator is provided with an easy means of ascertaining immediately whether he is straining the equipment. The ability of the platform thus to indicate stress and to take shock by moving will ensure a much longer life of the hydraulic boom than is the case when such a boom is tied to a non-movable concrete support pedestal which cannot absorb shocks. In this fashion, the maintenance on a hydraulic boom will be minimized. If the work area is particularly hard, members 16 and 17 could be fitted at their extremities with various forms of pads which may assist in giving these members a firmer footing.

Disassembly which is a feature of this invention is readily accomplished as required. For example, when the device is to be used for work in the interior of large ore bins, members 16 and 17 are rotated so as to form a 180° angle with members 10 and 11. The operator console and backhoe boom are detached from the platform by removing pins 4*a*, 4*b*, 4*c* and 4*d*. The hydraulic oil reservoir, pump and electric motor are then removed as a package. Once the backhoe boom and hydraulic package has been removed from the platform, the platform can be fitted through an opening in such an ore bin. It is envisioned that in most practical frames built according to this invention, the frame will pass through a rectangular hole approximately 7 feet by 3 feet. It will of course be obvious however, that in any given instance the platform could be made larger or smaller as particular requirements are met. Most large ore bins will be equipped with a hoist of intermediate capacity. Such a hoist would be sufficient to hoist up the demolition hammer or bucket, backhoe boom, hydraulic power package and the frame separately. However, it would probably not be sufficient to be able to hoist the assembled device nor a small track laying tractor. In this way, the disassembled device can be handled, in most plants, by existing hoisting equipment, whereas a track laying tractor with mounted boom could not be handled. When the equipment has been hoisted to the working area which may be either the interior of such an ore bin, or on a raised platform within a plant, the device is relatively easily reassembled by reassembling the hydraulic package, including tank pump and motor to the frame, the hydraulic backhoe package to the frame using pin attachments 4*a*, 4*b*, 4*c* and 4*d*, and attaching the bucket or demolition hammer to the hydraulic backhoe boom. When the working operation is completed the device can be disassembled and removed from the work area where it can then be reassembled and transported to a new working area.

Figure 4:
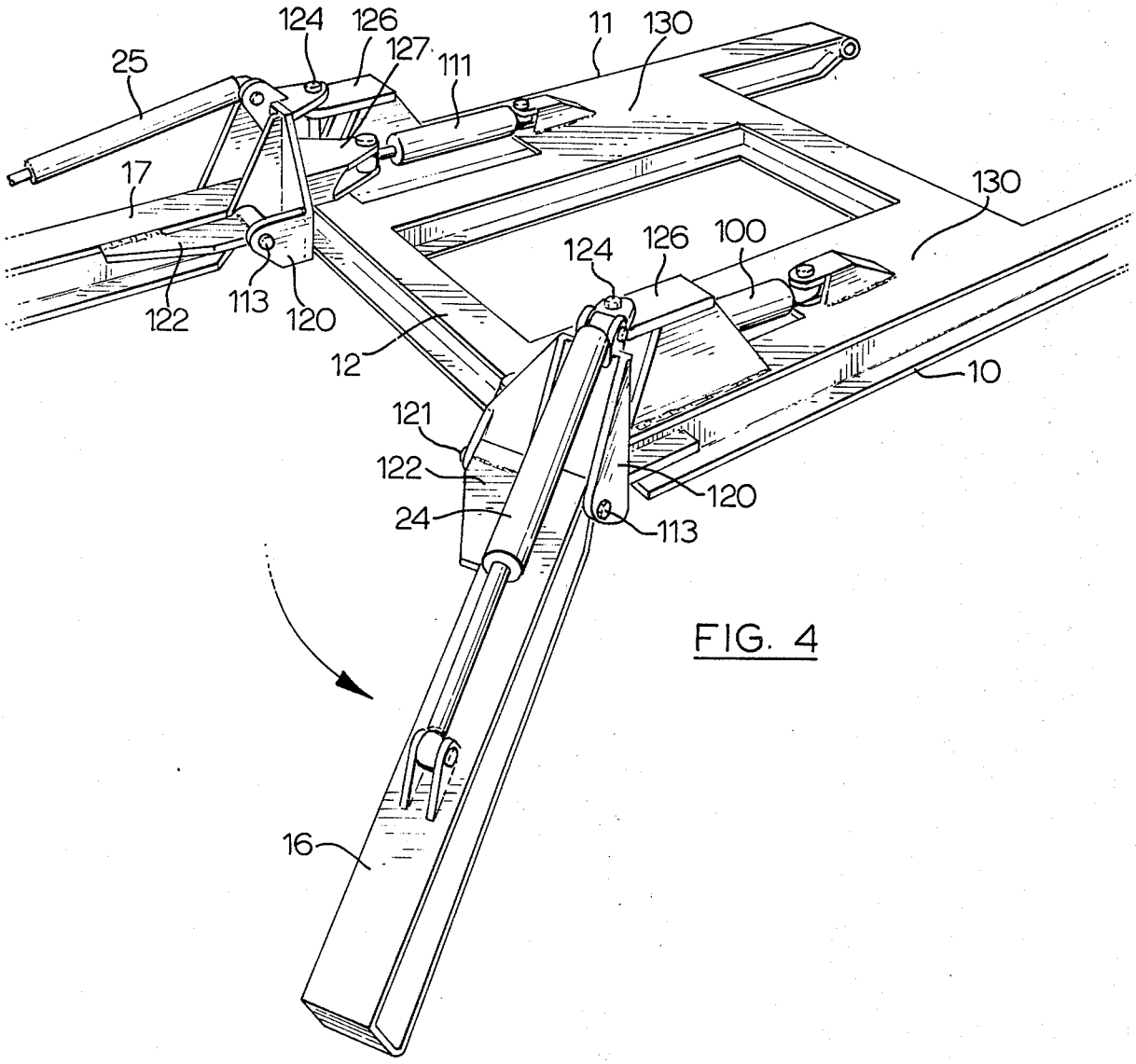
FIG. 4 is a perspective view of an improved embodiment of the platform of the invention with the hydraulic controls and equipment removed for clarity of illustration.

FIG. 4 illustrates an improved embodiment of the invention described hereinbefore. In this improved device, the members 16 and 17 have been provided with an additional pivot axis in order that they may rotate not only in a vertical plane but also in a horizontal plane. In certain applications where the device may be working in a relatively narrow platform, such as when removing fire brick from the interior of a refractory furnace, it may be of particular assistance to the operator to be able to rotate one of the members 16 or 17 to one side in order to obtain better access to the desired work area. Similarly, if the device is being used at the edge of a hole, it may be desirable to rotate each of members 16 and 17 slightly outwards in order that the device can work closer to the edge of the hole and still maintain the necessary safety. In other instances, it may be desirable to rotate one or other of members 16 or 17 outwardly, in order to prevent the particular member and associated hydraulic jack from being hit by the boom of the backhoe during operation of the backhoe.

In FIG. 4 the device is shown with members 16 rotated outwardly while member 17 forms a 180° angle with side member 11 in all planes. This view clearly illustrates both the inside and the outside of the double acting hinge. In order to assist in the clarity and description, the double acting hinge will be described in conjunction with member 16. The hinge member to which member 17 is affixed is identical to the member to which member 16 is affixed with the exception that of course the two members are mirror images of one another. For further clarity in understanding the description, like numbers have been used for both the right hand and left hand hinge members and for the pivot pins and braces.

The platform initially disclosed and described herein must be modified to include two further hydraulic cylinders 100 and 111 which provide the motive force to rotate members 16 and 17 through suitable linkages in the horizontal plane. In place of pin 22, as previously described, a pin 113 is journalled in the end of member 16 and brace member 122. The in-board end of this pin is journalled in pivoting member 120 and 121. It will be noted that this pin may be braced to member 16 by means of bracket or brace 122 which is welded to the pin journal and to member 16. It is also necessary to modify the upper anchor point for the hydraulic cylinder 24 which effects vertical movement of member 16. In FIG. 4 the cylinder is shown to be located to the movable member 120 in order that the cylinder will rotate in a horizontal plane together with member 16. By so mounting this cylinder, rotation in the horizontal plane does not effect the ability of member 16 to be rotated in a vertical plane. To the rear of hydraulic cylinder 24 is a vertical pin 124 which at its lower end is journalled in member 10. Pin 124 is journalled at its upper end in fixed brace member 126. Movable member 120 has a projection 127 which projects over member 12 to which is attached the hydraulic cylinder 100. Cylinder 100 is fixed at its rear end either on member 15 or on a suitable brace 130 welded or joined between members 10 and 15. By operation of hydraulic cylinder 100 the member 16 together with its movable hinge member 120 and hydraulic cylinder 24 may be made to rotate about vertical pin 124. At any degree of rotation about pin 124 the hydraulic cylinder 24 may be operated so as to move member 16 in a vertical plane.

A separate set of controls may be installed for operation of hydraulic cylinders 100 and 111. However, it is envisioned that the controls used for operation of cylinders 24 and 25 could probably be used for the operation of cylinders 100 and 111, if such cylinders shared a common hydraulic line equipped with suitable valves so that only one cylinder at a time would be operated.

Normally, the stroke of cylinder 100 and the dimension of projection 127 would be such that the member 16 may be made to rotate in the horizontal plane so as to form a 90° angle with member 10 as a limit. Rotation beyond the 90° angle would probably not be desirable, as this would mean that the member 16 when rotated in the vertical plane would provide a support point which would be to the rear of member 12. Similarly, it is expected that it would not be desirable to rotate member 16 inwardly from a position forming a 180° angle with member 10. However, the limits of rotation may be altered or varied simply by altering the stroke of cylinder 100 and the connecting linkage member 126. As explained previously, hydraulic cylinder 24 which controls the vertical motion of member 16 desirably would permit member 16 to be raised in the vertical direction until a 90° angle is formed with member 10 in a vertical plane. The length of stroke of cylinder 24 and the connecting linkage arrangement of member 16 will determine how far below a horizontal plane containing members 10 and 11, member 16 may be rotated. As previously explained, rotation below the horizontal plane containing members 10 and 11 may be desirable in order to provide working leverage. It will thus be seen that provision of a double pivot for member 16 provides additional flexibility for the device described herein without impairing any of its features as explained above.

While the device has been explained with reference to a particular embodiment of the invention it will be obvious to those skilled in the art that modifications may be made to the device without departing from the invention disclosed herein, and more particularly described in the claims attached.

What we claim as our invention is:

1. A platform for mounting a hydraulic implement for in plant use comprising a rigid portion; said rigid portion comprising a first rigid member defining a side of said rigid portion, a second rigid member substantially parallel to said first member defining an opposite side of said rigid portion and third and fourth members defining respectively ends of said rigid portion, all of said members being parallel to single plane; means for readily removably mounting a hydraulic implement comprising a hydraulic boom and operator console on said rigid portion whereby said implement may be readily removed from said platform and said platform and said implement may then be transported to within a confined area and readily reassembled therein, and a pair of ground engaging members independently affixed to one of said ends for independent pivotal movement about an axis parallel to said plane, each of said ground engaging members being pivotable from a first position wherein the angle between said plane and said ground engaging member is about 90°, through an arc of rotation greater than 90°, the lower surfaces of said ground engaging members and said rigid portion forming a substantially flat ground engaging plane when said ground engaging members are parallel to said plane of said rigid portion.

2. The platform of claim 1 wherein each of said ground engaging members is affixed to one of said end members for independent pivotal movement about an axis parallel to said plane and for independent pivotal movement about an axis perpendicular to said plane of said rigid portion.

3. The platform of claim 2 in which each of said ground engaging members may be pivoted about said axes by two independent hydraulic cylinders.

4. The platform of claim 2 wherein said hydraulic implement is attached to said platform by no more than four removable pins.

5. A readily disassemblable device for use in confined areas comprising a hydraulic implement consisting of a hydraulic boom and a control console, a motor and hydraulic pump and a ground engaging skid said skid comprising a rigid portion defined by at least four rigid members with their major axes parallel to a single plane and two ground engaging members pivotally affixed to one of said rigid members for independent pivotal movement about an axis parallel to said plane and for pivotal movement about independent axes perpendicular to said plane, said ground engaging members and said rigid portion forming a substantially flat ground engaging surface when said ground engaging members are positioned parallel to said plane, said implement and said motor and hydraulic pump being readily removably affixed to said skid, whereby said device may be readily disassembled, transported to within a confined space and reassembled therein for use of said device therein.

6. The device of claim 5 wherein said motor is electric.

7. The device of claim 5 wherein each of said gound engaging members is pivotable to a position where said ground engaging member is perpendicular to said single plane.

* * * * *